US010365035B2

(12) United States Patent
Lindel et al.

(10) Patent No.: US 10,365,035 B2
(45) Date of Patent: Jul. 30, 2019

(54) DOMESTIC REFRIGERATION APPLIANCE WITH AN ELECTRICAL PART ON A FRONT WALL ON A BEARING RIB AS WELL AS METHOD FOR PRODUCING A DOMESTIC REFRIGERATION APPLIANCE

(71) Applicant: BSH HAUSGERAETE GMBH, Munich (DE)

(72) Inventors: Andreas Lindel, Heidenheim (DE); Ralf Spiller, Giengen (DE); Claudia Weiss, Neu-Ulm (DE); Felix Wiedenmann, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/792,829

(22) Filed: Oct. 25, 2017

(65) Prior Publication Data

US 2018/0112912 A1 Apr. 26, 2018

(30) Foreign Application Priority Data

Oct. 26, 2016 (DE) ..... 10 2016 221 026

(51) Int. Cl.

| | |
|---|---|
| ***F25D 29/00*** | (2006.01) |
| ***F25D 23/06*** | (2006.01) |
| ***F25D 27/00*** | (2006.01) |

(52) U.S. Cl.

CPC ..... *F25D 29/005* (2013.01); *F25D 23/066* (2013.01); *F25D 23/067* (2013.01); *F25D 27/00* (2013.01); *F25D 2400/40* (2013.01)

(58) Field of Classification Search

CPC .... F25D 29/005; F25D 23/066; F25D 23/067; F25D 27/00; F25D 2400/40; A47F 1/00

See application file for complete search history.

(56) References Cited

U.S. PATENT DOCUMENTS

| | | | | |
|---|---|---|---|---|
| 3,504,147 | A * | 3/1970 | Christman | F25D 23/085 200/295 |
| 9,010,884 | B2 * | 4/2015 | Heinrich | F25D 23/067 312/223.6 |
| 9,793,763 | B2 * | 10/2017 | Lee | H02J 50/12 |
| 2001/0053066 | A1 * | 12/2001 | Malnati | F25D 29/005 361/752 |
| 2003/0033824 | A1 * | 2/2003 | Sanna | F25D 25/024 62/229 |
| 2003/0094009 | A1 * | 5/2003 | Park | F25D 11/022 62/229 |

(Continued)

FOREIGN PATENT DOCUMENTS

| | | | |
|---|---|---|---|
| DE | 102010043546 A1 | 5/2012 | |
| WO | WO-2015089734 A1 * | 6/2015 | F21V 33/0044 |

*Primary Examiner* — Hanh V Tran

(74) *Attorney, Agent, or Firm* — Laurence A. Greenberg; Werner H. Stemer; Ralph E. Locher

(57) ABSTRACT

A domestic refrigeration appliance includes a housing in which an inner container is disposed. The inner container has walls delimiting a receiving chamber for food. A bearing rib for supporting a separating plate is formed or molded on a side wall of the inner container. An electrical part disposed on the front face of the bearing rib extends through a passage in the front face and projects into the receiving chamber. A method for producing a domestic refrigeration appliance is also provided.

16 Claims, 4 Drawing Sheets

(56) References Cited

U.S. PATENT DOCUMENTS

2004/0148949 A1* 8/2004 Parachini ..... F25D 25/024
62/126
2005/0279122 A1* 12/2005 Cohen ..... F25D 11/00
62/441
2006/0087207 A1* 4/2006 Oh ..... A47B 51/00
312/402
2006/0260345 A1* 11/2006 Coulter ..... F25C 5/24
62/340
2007/0093102 A1* 4/2007 Park ..... F25D 29/005
439/164
2009/0100859 A1* 4/2009 Choi ..... F25D 29/005
62/440
2009/0121598 A1* 5/2009 Kang ..... F25D 23/00
312/401
2009/0133425 A1* 5/2009 Goerz ..... F25D 17/067
62/264
2009/0302724 A1* 12/2009 Allard ..... F25D 17/042
312/237
2013/0020922 A1* 1/2013 Jang ..... F25D 25/024
312/408
2013/0106274 A1* 5/2013 Yang ..... F25D 23/067
312/404
2014/0015394 A1* 1/2014 Cha ..... B23P 15/26
312/404
2016/0086747 A1* 3/2016 Goodwin ..... H01H 13/14
200/52 R
2016/0116206 A1* 4/2016 Kempfle ..... F25D 23/028
312/405
2016/0273750 A1* 9/2016 Burke ..... F21V 23/06

* cited by examiner

DOMESTIC REFRIGERATION APPLIANCE WITH AN ELECTRICAL PART ON A FRONT WALL ON A BEARING RIB AS WELL AS METHOD FOR PRODUCING A DOMESTIC REFRIGERATION APPLIANCE

CROSS-REFERENCE TO RELATED APPLICATION

This application claims the benefit, under 35 U.S.C. § 119, of German Patent Application DE 10 2016 221 026.2, filed Oct. 26, 2016; the prior application is herewith incorporated by reference in its entirety.

BACKGROUND OF THE INVENTION

Field of the Invention

The invention relates to a domestic refrigeration appliance with a housing in which an inner container is disposed. The walls of the inner container delimit a receiving chamber for food. A bearing rib for supporting a separating plate is molded or formed on a side wall of the inner container. The invention also relates to a method for producing such a domestic refrigeration appliance.

In domestic refrigeration appliances for holding food, which can be a refrigerator or a freezer or a combined refrigerator/freezer, provision is also made for a range of different components to be disposed in the inner container. Light sources, for example, are therefore also disposed therein, to light the interior of the inner container and therefore the receiving chamber. Production processes in particular mean that such additional components can only be incorporated at specific points. That restricts the functionality of the domestic refrigeration appliance.

Further components can also include servomotors for regulating air humidity, temperature sensors for different refrigeration zones, etc. Generally, such components are incorporated after the introduction of the thermal insulation material in a space between the inner container and an external housing of the housing as a whole. Since the electricity supply systems and therefore cables for the components have to be put into position before the thermally insulating material is introduced, specific conditions apply for all such in particular electrical components at different points and such electrical components can therefore only be incorporated at those very specific points. Backing pieces are also used for that purpose.

A backing piece for fastening an electrical component to a housing wall of a domestic refrigeration appliance is known from German Patent Application DE 10 2010 043 546 A1, corresponding to U.S. Pat. No. 9,010,884.

SUMMARY OF THE INVENTION

It is accordingly an object of the invention to provide a domestic refrigeration appliance with an electrical part on a front wall on a bearing rib as well as a method for producing a domestic refrigeration appliance, which overcome the hereinafore-mentioned disadvantages of the heretofore-known appliances and methods of this general type, which improve the functionality of a domestic refrigeration appliance and which permit the incorporation of additional components in a more flexible manner.

With the foregoing and other objects in view there is provided, in accordance with the invention, a domestic refrigeration appliance comprising a housing in which an inner container is disposed. The domestic refrigeration appliance includes a receiving chamber for food, which is delimited by walls of the inner container. A bearing rib for supporting a separating plate is molded or formed on a wall of the inner container which is configured as a side wall of the walls. One important concept of the invention is that an electrical part extending through a passage in the front face and projecting into the receiving chamber is disposed on the front face of the bearing rib. This configuration means that a specific additional component, specifically an electrical part, creates an exposed position, which allows it to establish particular proximity to the separating plate. It also allows very short line paths for connecting the electrical part, in particular to corresponding components in or on the separating plate. Such a configuration also means that the electrical part can be incorporated in a certain protected manner since the separating plate then also covers the electrical part from above, when the separating plate is disposed on the bearing rib. One further advantage is that the bearing rib creates a functional part of the inner container that is present anyway, which is now also configured as a support for the electrical part by the additional holder. The bearing rib is thus a multifunctional part. It is also advantageous in this context that no additional specific holding geometry has to be created for the electrical part on a wall of the inner container, thereby also reducing the complexity of the shape of the inner container. There is therefore no need to create an additional projection or hollow in addition to the bearing rib on a wall of the inner container to hold the electrical part. This specific positioning of the electrical part on the bearing rib also means that space is used that could otherwise not be used and at the same time space in the side wall of the inner container is released for the positioning of other components.

Provision is made in particular for the electrical part or component to be an electric plug. This is very advantageous in that an interface between electrical components is then provided at this local point. Contact and corresponding insulation are then advantageously possible at those points.

Provision is preferably made for a separate support element to be disposed in the passage in the front face, the separate electrical part being disposed thereon. The support element is in particular a backing piece, which in turn is correspondingly advantageous when producing the domestic appliance. The additional support element allows the electrical part to be positioned more efficiently, since the support element can on one hand be configured individually for mechanical coupling to the front face and thus the electrical part per se can remain substantially unchanged. There is therefore no need for any modification of the electrical part, which would then allow the necessary mechanical coupling to the front face to fasten it directly thereto. Also, the separate support element makes incorporation of the electrical part easier, which is also advantageous. The support element can then also configure the corresponding interface with the passage in the front face individually, which also has particular advantages with respect to mechanical stability, long-term positional reliability and seal.

Provision is preferably made for the support element to extend on both sides of the passage. The advantages cited above are further enhanced as a result.

Provision is preferably made for the support element to be configured in the manner of a sleeve. Such a duct-shaped or shaft-shaped configuration means that the electrical part can be held more efficiently and can be kept in position on the support element in the long term. Such a configuration also makes access from both sides of the support element particularly easy and assembly-friendly.

Provision is preferably made for the support element to have a collar-shaped, in particular completely circumferential, sealing flange, which rests on a surface of the front face. This is a particularly advantageous embodiment, since the interface with the passage is thus sealed. The ingress of media, in particular thermally insulating material such as insulating foam, is thus prevented. This configuration also allows the support element to be incorporated on the front face and therefore also on the bearing rib with particular positional reliability.

Provision is made in particular for the sealing flange to be configured on both sides and for a first sealing flange region thereof to rest on a first surface of the front face and a second sealing flange region to rest on a second surface of the front face opposite the first surface. Such contact on both sides allows the support element to be disposed so that it is clamped to the front face and to be braced from both sides. This ensures particularly stable mechanical fastening, preventing unwanted relative movement of the support element in relation to the front face.

Provision is preferably made for the support element to have a shaft-shaped receiving piece for holding a counter-element that can be connected to the electrical part.

Provision is made in particular for a height of the electrical part to be smaller than a height of the front face and for the electrical part to be disposed in the passage in such a manner that the electrical part is positioned completely within the height of the front face. This prevents the electrical part from protruding upward or downward so that on one hand the separating plate can be positioned easily on the bearing rib without the electrical part getting in the way and on the other hand the electrical part also does not protrude down beyond the bearing rib, thereby also meaning that other components and/or stored items do not push against it in an unwanted manner.

Provision can be made for the passage in the front face and/or the electrical part extending through the passage and projecting into the receiving chamber to be configured or disposed in a rear end segment of the bearing rib in a depthwise direction of the domestic refrigeration appliance. This allows simpler production, since a bracing tool, for example a tool core or slider, which braces the inner container from the inside when the domestic refrigeration appliance is foamed, can be inserted into the inner container in a depthwise direction to the passage or electrical part but does not have to brace any regions behind the passage or electrical part in a depthwise direction. This allows the tool structure to be simplified. An end segment is in particular a segment of the bearing rib, which extends from its rear end by 25%, preferably 20% and more preferably 10% of the extension of the bearing rib in a depthwise direction.

Provision is preferably made for the domestic refrigeration appliance also to include the separating plate and for the separating plate to rest on the bearing rib, with the electrical part in particular being disposed to overlap at least partially with the separating plate when viewed in a heightwise direction of the domestic refrigeration appliance. Such an overlap in a heightwise direction means that the electrical part is covered or held at least partially by the separating plate on its face projecting into the receiving chamber. This further enhances the protected position and also allows simple connection to a counter-element with only very short cable lengths.

In a further advantageous embodiment provision is made for the separating plate to have a recess or cutout on its lower face, into which at least segments of the electrical part are inserted substantially completely or completely. The recess can be configured in a rear corner region of the separating plate in a depthwise direction. The recess can be open at the rear in a depthwise direction and/or at the bottom in a heightwise direction and/or on a side facing the inner container in a widthwise direction. The recess can be delimited by a wall of the separating plate at the front in a depthwise direction and/or at the top in a heightwise direction and/or on a side facing away from the inner container for chilled items in a widthwise direction. The advantages cited above are further enhanced as a result.

At least one electrical component is preferably disposed on the separating plate, being able to be coupled electrically to the electrical part. The electrical component, which can also be a counter-element, can be a light source or a motor-driven drive or a sensor, for example a temperature sensor, or the like. Specifically, when such further electrical components or counter-elements are incorporated in or on the separating plate itself, the position of the electrical part on the bearing rib is very advantageous, in order to be able to establish the shortest possible connections and allow protected incorporation.

Provision is preferably made for the electrical part to be covered from below by a lower face cover. The lower face cover is a separate component, in particular also separate from the separating plate. The advantageous embodiments cited above in particular allow the electrical part also to be substantially completely housed, thereby providing not only better protection from mechanical damage and therefore impact protection or the like but also providing better protection from moisture, for example splashed water or the like. This is very advantageous particularly for an electrical part.

In a further embodiment, provision is made for a loading opening of the inner container to be divided into two loading opening regions by a horizontal bar-shaped separating panel. The electrical part, or at least segments thereof, is disposed at the same height as the separating panel when viewed in a heightwise direction of the domestic refrigeration appliance. This means that at least segments of the electrical part are disposed behind the separating panel when viewed in a depthwise direction of the domestic refrigeration appliance. It is possible for the electrical part to be disposed completely at the same height as the separating panel, so that the electrical part is disposed completely behind the separating panel when viewed in a depthwise direction of the domestic refrigeration appliance. In both instances provision can be made for the electrical part to be disposed behind the separating panel when in a depthwise direction of the domestic refrigeration appliance. With such embodiments of the domestic refrigeration appliance provision is preferably made for a single receiving chamber for food to be provided, with its loading opening being separated into two separate loading opening regions by such a separating panel. Provision can then be made in particular for a separating plate to be inserted at this height of the separating panel, then resting on corresponding bearing ribs, so that the originally single continuous receiving chamber is separated into two sub-regions.

The sub-regions then extend on one hand above the separating panel and the separating panel, which is inserted in such a manner that it can be removed non-destructively, and on the other hand below the separating panel and the separating plate. With such configurations provision can also be made in particular for a single door to be disposed on the housing, the door being able to close the entire loading opening and therefore also the loading opening regions separated by the separating panel. Alternatively, provision can also be made in this case for the first loading opening region to be able to be closed by a first door with a surface tailored thereto and for the second loading opening region to be able to be closed by a door which is separate from the first door and also has a surface tailored thereto.

With such embodiments, in which such a separating panel is present and in which bearing ribs with a separating plate are disposed at the height to separate the volume of the receiving chamber, the production of the domestic refrigeration appliance has been problematic to date in that during the introduction of the thermal insulation material outside the inner container, the inner container has been braced correspondingly using tools but it was very difficult to attach electrical parts or such electrical parts could only be positioned as the tools allowed. The incorporation of electrical parts, in particular before the introduction of the thermal insulation material, was thus limited. This also limited the flexibility of local incorporation of such electrical parts, with corresponding disadvantages. This is now resolved by the invention.

With the objects of the invention in view, there is concomitantly provided a method for producing a domestic refrigeration appliance according to the invention or an advantageous configuration thereof. In the course of the method the support element is inserted into the passage and the electrical part is inserted into the support element. A thermally insulating material, in particular an insulating foam, is only introduced into the housing in a region outside the inner container after the support element has been fitted and after the electrical part has been fitted, so that the electrical part is surrounded by the thermally insulating material outside the inner container.

The resulting advantages have been described above. This method also allows electrical parts to be fitted at quite specific points on the inner container which were not possible before and before the introduction of the thermal insulation material in a space between the inner container and an external housing of the housing as a whole. It is then also possible, even though the electrical part is already incorporated and extends into the receiving chamber, to introduce stabilizing tools and then brace the inner container correspondingly when the thermally insulating material is subsequently introduced. When the configuration is such that the separating panel is present and the electrical part is also disposed at the same height on the bearing rib as the separating panel, a corresponding stabilizing tool can still be inserted into the inner container, without the projecting electrical part being in the way. It is then possible to brace the inner container all around to then introduce the insulating foam into the housing, in particular also on the bearing rib.

With the method it is therefore then also possible, after fitting the electrical part, for a specific tool for bracing the inner container from the inside to be inserted in an opened state. This means that the tool, which has a core and sliders that can be moved relative thereto, can be inserted into the interior of the inner container and the relative movement of the sliders in relation to the core that takes place during insertion is not impeded. This is also the case specifically at the point behind the separating panel, which can also be fitted before the thermally insulating material is introduced. The sliders can therefore also move correspondingly relative to the core and the separating panel can then be braced from the rear. In particular, a slider of the tool is configured with a recess or pocket, in which, when the tool is in its bracing end state in the inner container, the region of the electrical part extending into the receiving chamber of the inner container is held or the electrical part is inserted therein. The bearing rib is thus stabilized by the slider and the electrical part is also no longer in the way when the tool is brought into the inner container.

It is a further concept of the invention to create a tool for bracing an inner container of a domestic refrigeration appliance from the inside. Provision is made in this case for the tool to have a tool core and sliders that can be displaced relative thereto, a slider having a cutout or pocket for holding a part of an electrical part extending into the inner container, with the electrical part being disposed on a bearing rib of the inner container of the domestic refrigeration appliance and extending at least partially into the receiving chamber for food, which is delimited by walls of the inner container.

The terms "top," "bottom," "front," "rear," "horizontal," "vertical," "depthwise direction," "widthwise direction," "heightwise direction," etc. indicate the positions and orientations when the appliance is used and disposed in the correct manner and for an observer standing in particular in front of the appliance and looking in the direction of the appliance.

Further features of the invention will emerge from the claims, figures and description of the figures. The features and feature combinations cited above in the description and the features and feature combinations cited below in the description of the figures and/or simply shown in the figures can be used not only in the combination specified in each instance but also in other combinations, without departing from the scope of the invention. Embodiments of the invention, which are not shown and described specifically in the figures but emerge and can be generated from the described embodiments as a result of separate feature combinations, should also be considered to be included and disclosed. Embodiments and feature combinations, which therefore do not have all of the features of an originally formulated claim, should also be considered to be disclosed. Embodiments and feature combinations, which go beyond or deviate from the feature combinations set out in the claim references, should also be considered to be disclosed, particularly through the embodiments set out above.

Other features which are considered as characteristic for the invention are set forth in the appended claims.

Although the invention is illustrated and described herein as embodied in a domestic refrigeration appliance with an electrical part on a front wall on a bearing rib as well as a method for producing a domestic refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
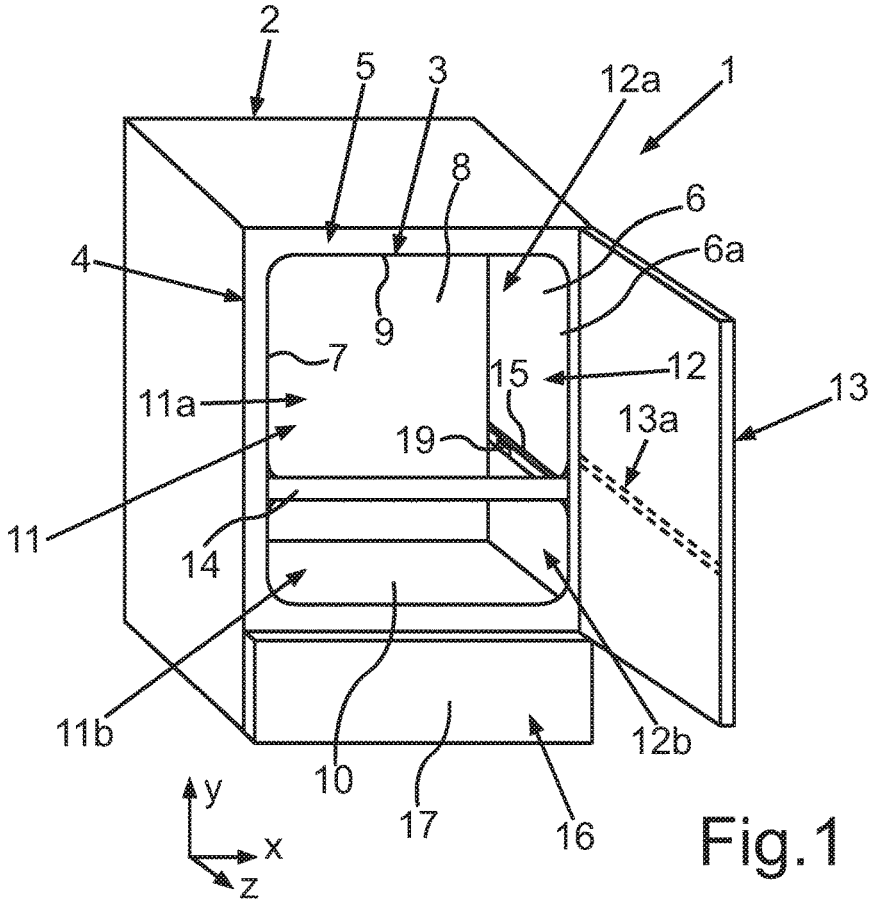
FIG. 1 is a diagrammatic, perspective view of an exemplary embodiment of a domestic refrigeration appliance according to the invention.

Referring now in detail to the figures of the drawings, in which identical elements or elements of identical function are provided with the same reference characters, and first, particularly, to FIG. 1 thereof, there is seen a diagrammatic, perspective view of a domestic refrigeration appliance 1. The domestic refrigeration appliance 1 can be a refrigerator or a freezer or a combined refrigerator/freezer. The domestic refrigeration appliance 1 can have one receiving chamber for food or a number of receiving chambers for food, which may also, in particular, be separate.

In the exemplary embodiment provision is made for the domestic refrigeration appliance 1 to have a housing 2, at which an inner container 3 is disposed. The housing 2 also includes an external housing 4, which is disposed at a distance from the inner container 3. A thermally insulating material, in particular an insulating foam, is introduced into a space 5 between the inner container 3 and the external housing 4.

The inner container 3 is, in particular, made of plastic. The inner container 3 includes walls 6 and 7, which are vertical side walls, a rear wall 8, a top wall 9 and a bottom wall 10. The front of the inner container 3 has a loading opening 11, by way of which items to be stored can be introduced into or taken from a receiving chamber 12.

The front of the receiving chamber 12 can be closed by a door 13, which is disposed pivotably on the housing 2.

In one very advantageous embodiment, provision is made for this one continuous receiving chamber 12 to be separated. In particular, provision is made for the loading opening 11 to be divided into two loading opening regions 11*a* and 11*b*, with a horizontal bar-type separating panel 14 fitted at the front for this purpose.

As is shown in FIG. 1, there is as yet no further component, in particular no separating plate, disposed behind the separating panel 14, so that the receiving chamber 12 still forms a completely continuous and single volume behind the separating panel 14.

As is also shown in FIG. 1, a bearing rib is molded on each of the vertical side walls 6 and 7, although only one elongated bearing rib 15 oriented horizontally in a depthwise direction is shown on an inner face 6*a* of the wall 6 in FIG. 1. The bearing rib, which projects inward in a raised manner, extends substantially over the entire depth of the inner container 3, with the depth being calculated in a depthwise direction (z direction). The bearing rib 15 is configured as a single piece with the similarly single-piece inner container 3 and serves as a support for the separating plate mentioned above.

Provision can be made, even in a configuration in which the separating panel 14 is present, for just the one door 13 mentioned above to be present or, as shown by the broken line 13*a*, for two separate doors to be present, which can be used to close the respective sub-regions of the receiving chamber 12, which are formed by the inserted separating plate, separately. The surfaces of the two separate doors are then dimensioned in such a way that they cover the respective loading opening regions 11*a* and 11*b* formed by the separating panel 14 individually at the front.

Provision can also be made for the domestic refrigeration appliance 1 additionally to have a further receiving chamber 16, which can, for example, be a freezer compartment and which can be closed by a further door 17, which can be a front face of a drawer. With such a configuration, the receiving chamber 12 is then in particular a chiller compartment.

Figure 2:
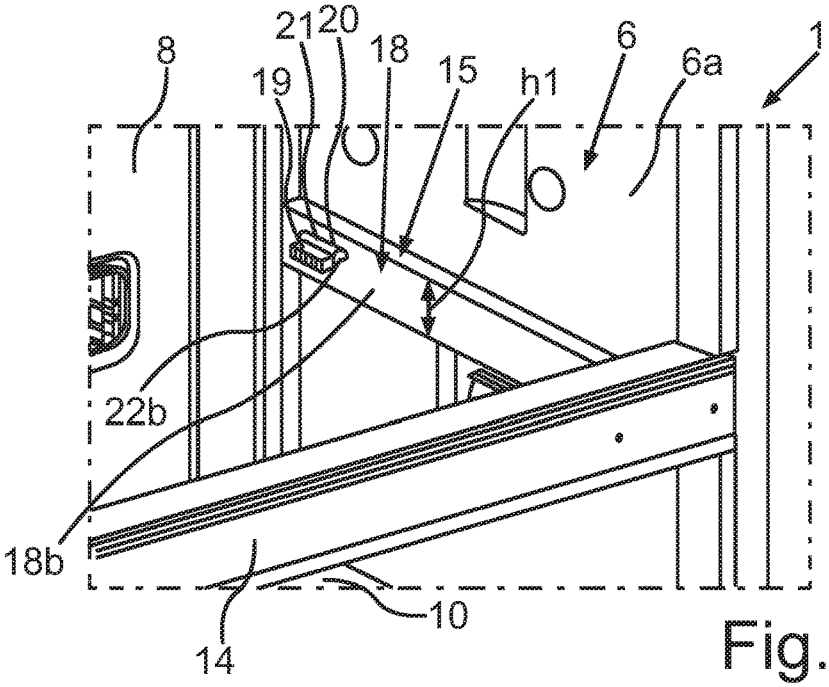
FIG. 2 is an enlarged, fragmentary, perspective view of a sub-region of the domestic refrigeration appliance according to FIG. 1.

FIG. 2 shows an enlarged, fragmentary view of the domestic refrigeration appliance 1 according to FIG. 1, with the separating panel 14 being shown in more detail herein. The bearing rib 15 is also shown in more detail. It can be seen in this case that the bearing rib 15 has a front face 18 oriented in a heightwise direction (x direction), which has a height h1 calculated in the heightwise direction. A separate electrical part or component 19, in particular a plug, is disposed on the bearing rib 15 and in particular on its front face 18. The electrical part 19 extends through a passage 20 or hole in the front face 18 and in the fitted state shown extends on both sides of the front face 18. In its fitted end position, the electrical part 19 therefore also extends into the receiving chamber 12 when viewed in a widthwise direction (x direction) and therefore projects inward into the receiving chamber 12 beyond the front face 18.

Provision is also made for a separate support element 21 to be present, which is inserted into the front face 18 in the region of the passage and into which the electrical part 19 in turn is then introduced. The additional support element 21 is in particular a backing piece.

As is shown in FIG. 2, the electrical part 19 is disposed in a rear half of the length (the length of the bearing rib 15 is calculated in a depthwise direction and thus in the z direction), in particular in a rear third of the length of the bearing rib 15. This configures a space that is well protected and relatively far away from the loading opening 11. The electrical part 19 is not in the way as stored items are moved in and out, and it can thus itself also be protected from damage by this rear position.

Figure 3:
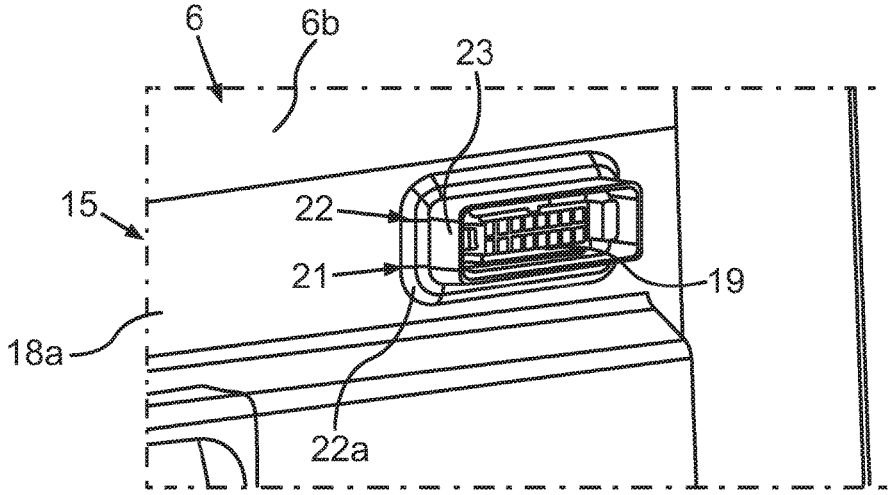
FIG. 3 is a further enlarged, fragmentary, perspective view of a sub-region of the domestic refrigeration appliance according to FIG. 1 with an outer face of an inner container of the domestic refrigeration appliance facing away from a receiving chamber for food.

FIG. 3 shows a further enlarged view of the domestic refrigeration appliance 1 in the region of the bearing rib 15. FIG. 3, however, does not show the inner face 6*a*, which faces the receiving chamber 12. Instead, it shows an outer face 6*b* of the wall 6 opposite the inner face 6*a* and facing away from the receiving chamber 12. The corresponding indentation or bulge of the bearing rib 15 in the direction of the receiving chamber 12 is also shown therein. It can also be seen from FIG. 3 that the electrical part 19 extends on both sides of the wall 6.

FIG. 3 also shows a more detailed view of the support element 21. It has a collar-like and in particular completely circumferential sealing flange 22, a first sealing flange region 22*a* of which rests on a surface 18*a* of the front face 18.

The sealing flange 22 is configured correspondingly on the opposing side so that, as is also shown in FIG. 2, a further sealing flange region 22*b* is provided, which rests on a further surface 18*b* of the bearing rib 15, in particular the front face 18.

As is shown in FIG. 3, the support element 21 also has a shaft-like receiving piece 23 adjoining the sealing flange 22 and protruding from the sealing flange 22. The receiving piece 23 holds the contact region of the electrical part 19 and surrounds it or encloses it in the manner of a frame. The receiving piece 23 thus also serves as a mechanical panel or as impact protection for the electrical part 19 and also serves similarly as a receiving guide for the element also to be connected to the electrical part 19. In the view in FIG. 3 provision is then made for cable connections to be provided on this side of the electrical part 19. The cable connections are then also pushed into the receiving piece 23 and held there as a result. Provision is preferably made for the support element 21 to be provided on both sides of the front face 18 with respect to the sealing flange 22 but for the receiving piece 23 only to be provided on one side, in particular on the side facing away from the receiving chamber 12.

Figure 4:
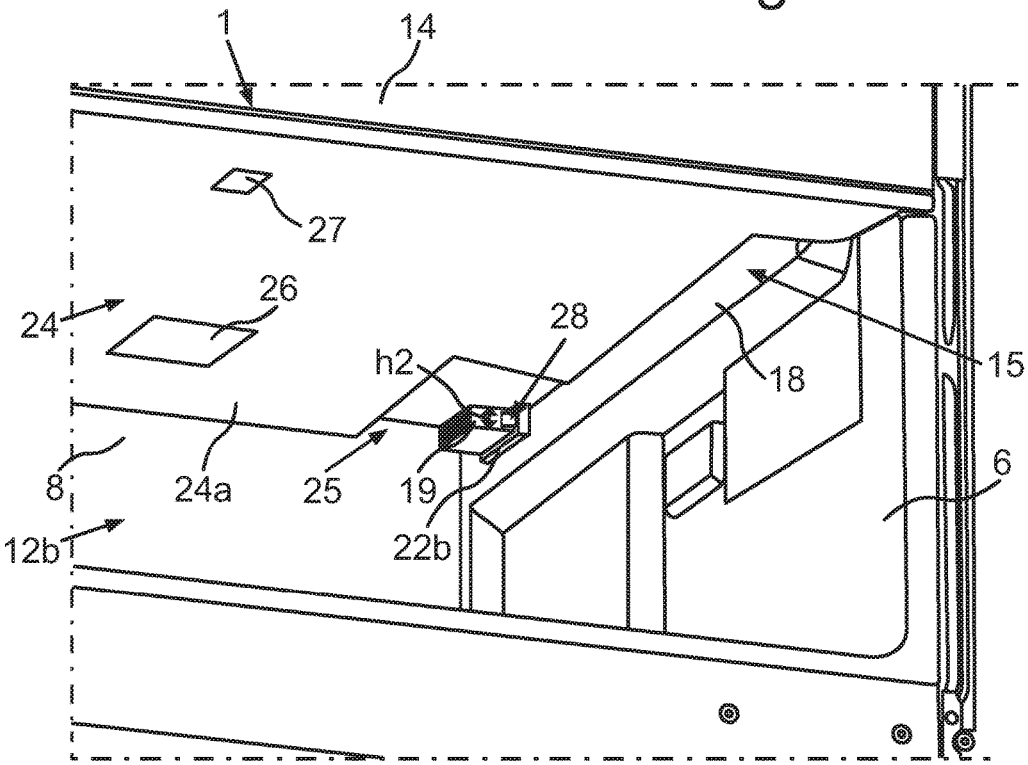
FIG. 4 is a fragmentary, perspective view of the domestic refrigeration appliance in sub-components with an additionally inserted separating plate.

FIG. 4 shows a perspective view of the domestic refrigeration appliance 1 in the region of the separating panel 14. In contrast to the view in FIG. 2 provision is made in this case for a separating plate 24 to be already inserted, which is then disposed at the same height as the separating panel 14 when viewed in a heightwise direction. Therefore, when viewed from the front, the separating plate 24 is covered by the separating panel 14 at the front. Provision is also made in particular for the bearing rib 15 also to be disposed at the same height as the separating panel 14 and thus to be covered by the separating panel 14 in particular at the front when viewed from the front.

The electrical part 19 is therefore also at the same height as the separating panel 14 when viewed in a heightwise direction and is therefore covered by the separating panel 14 when viewed from the front.

At least one electrical functional element, which can be brought into contact with the electrical part 19, is disposed in the separating plate 24 which can be removed and reinserted non-destructively. As is shown in FIG. 4, the separating plate 24 has a recess or cutout 25 on a lower face 24*a*, in particular in a rear corner region, into which the region of the electrical part 19 extending into the receiving chamber 12 extends, when the separating plate 24 is in the fitted state or is inserted therein. Therefore, when viewed in a heightwise direction, the separating plate 24 is disposed so that it overlaps with the electrical part 19 when the separating plate 24 is in the fitted end position.

An electrical functional element or counter-element, which is disposed in or on the separating plate 24 can, for example, be at least one light source, a sensor, a motor-driven drive, etc.

For example, a servomotor 26 can be disposed in the separating plate 24. A counter-element 27 in the separating plate 24 can be connected to the electrical part 19. A light source, the number and position of which are only shown symbolically in FIG. 4, is preferably disposed in such a manner that it can light a sub-region 12*b* of the receiving chamber 12. The sub-region 12*b* in this case is the lower region, which is separated by the separating plate 24. A further upper sub-region 12*a*, separated from it by the separating plate 24, is shown in FIG. 1.

Provision is preferably made for a keep-fresh compartment to be provided in the lower sub-region 12*b*. A different air humidity and/or temperature can be set in this case as compared with the upper sub-region 12*a*. For example, vegetables and fruit can be kept fresh for longer in the keep-fresh region, which is formed by the sub-region 12*b*.

FIG. 4 also shows how the separating plate 24 rests on the bearing rib 15.

FIG. 4 additionally shows the sealing flange region 22*b*. It also shows that the electrical part 19 is preferably latched to the support element 21, with it being possible for latching elements 28 to be provided in this case. A height h2 of the electrical part 19 is shown and it can be seen that it is smaller than the height h1 and the electrical part 19 is disposed completely within the height h1.

Figure 5:
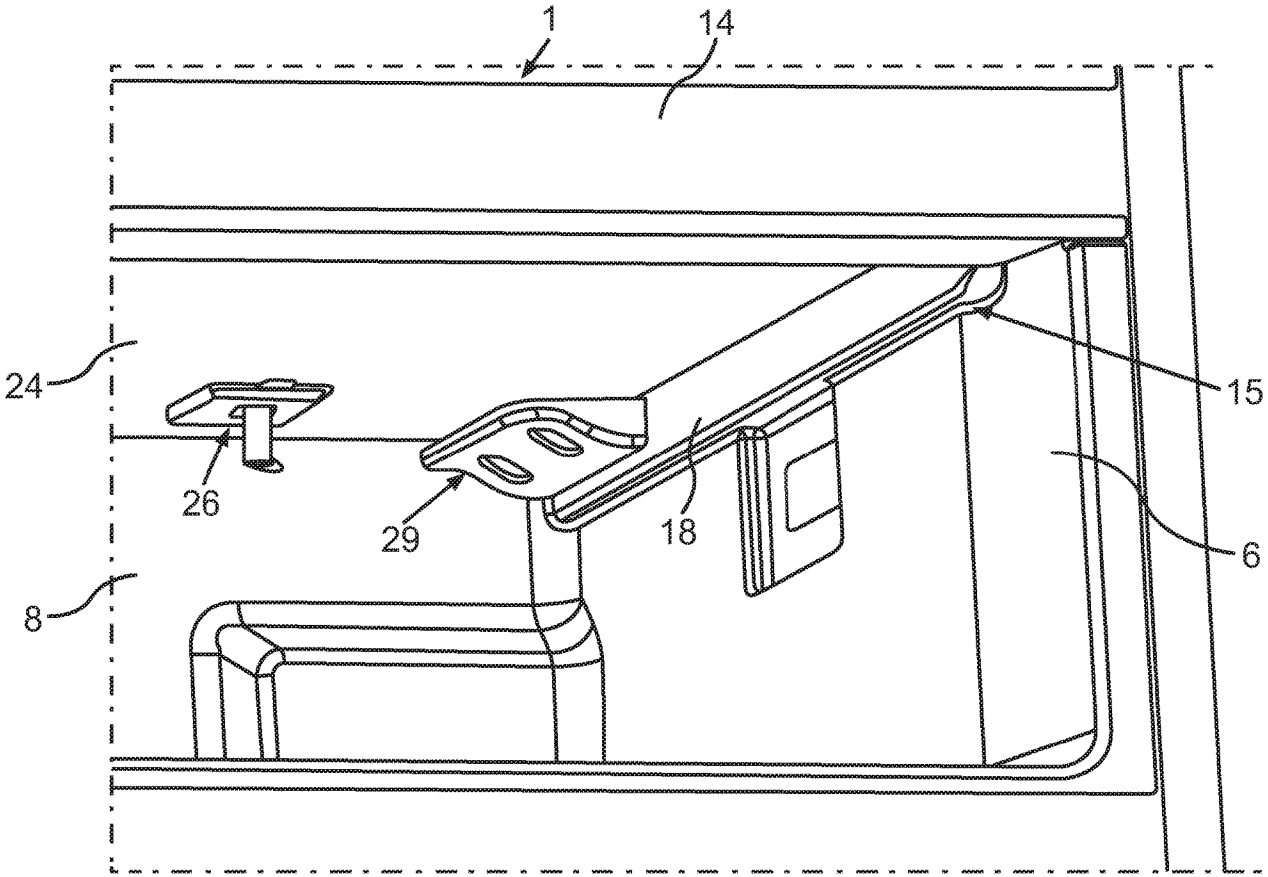
FIG. 5 is a fragmentary, perspective view of the domestic refrigeration appliance according to FIG. 4 with an additional lower face cover.

FIG. 5 shows the view of FIG. 4, but with an additional separate lower face cover 29 in contrast thereto, by which the electrical part 19 is covered from below, in the region in which it extends into the receiving chamber 12, in particular the sub-region 12*b*.

The lower face cover 29 can be disposed, in particular plugged in or latched thereto, so that it can be removed non-destructively.

Figure 7:
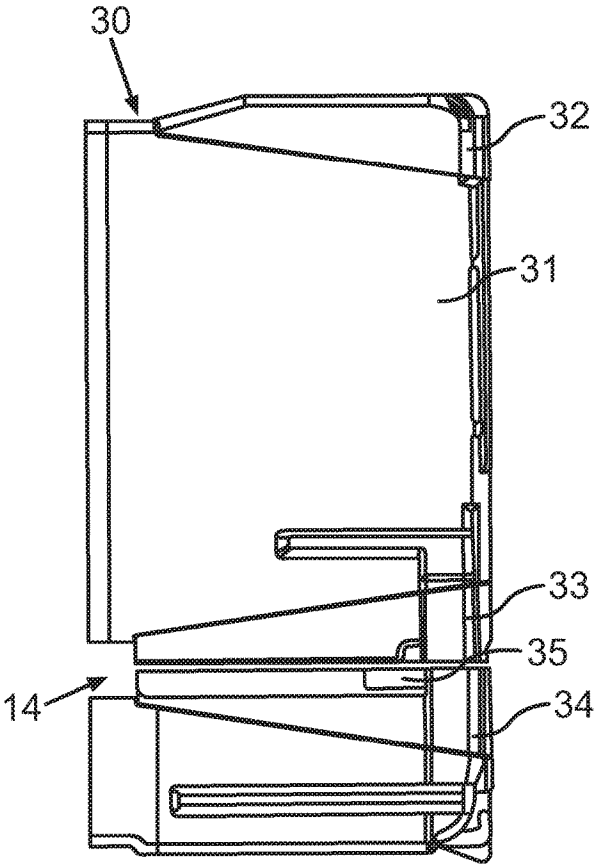
FIG. 7 is a perspective view of the tool according to FIG. 6 in the closed state.
Figure 6:
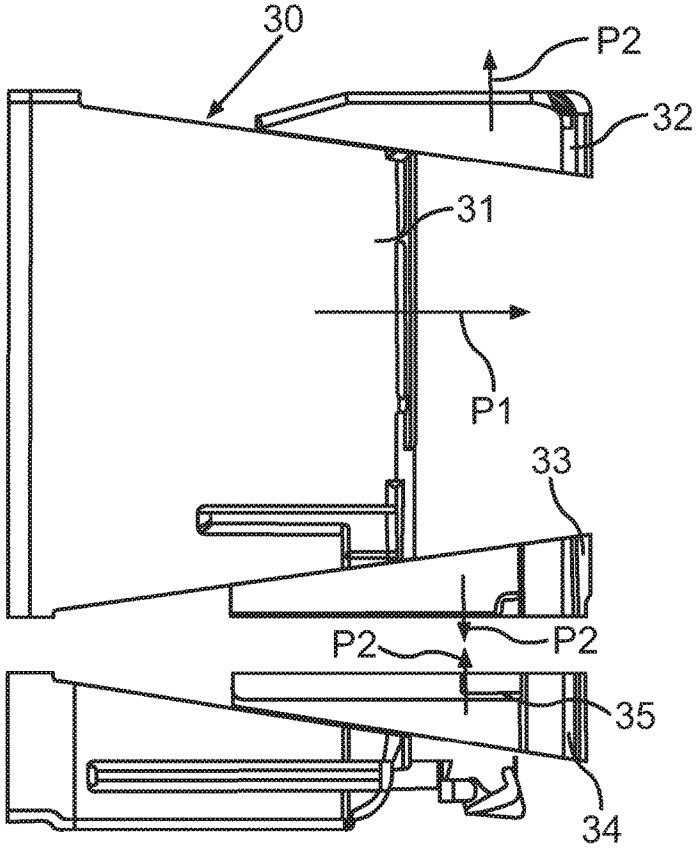
FIG. 6 is a fragmentary, perspective view of an exemplary embodiment of a tool for bracing the inner container from the inside in an opened state.

FIG. 6 shows a side view of an exemplary embodiment of a tool 30, with which the inner container 3 is braced from the inside and thus from the subsequently formed receiving chamber 12, when the thermal insulation material is introduced into the space 5. The tool 30 is shown in the so-called opened state in FIG. 6, in which a tool core 31 is displaced relative to sliders 32, 33 and 34. The tool core 31 and the sliders 32 to 34 make contact with one another on respective angled sides and can move relative to one another there. The slider 34 has a cutout 35, into which the electrical part 19 is inserted when the tool 30 is present in the closed state, as shown in FIG. 7. The closed state according to FIG. 7 is reached when the tool 30 is inserted completely into the interior of the inner container 3 and the inner container is thus braced from the inside. The sliders 33 and 34 brace the separating panel, which is not yet shown in FIG. 6 and FIG. 7 but the position of which is shown with reference character 14. As is indicated by the arrow P1 in FIG. 6, the core 31 is inserted into the interior of the inner container 3 in a depthwise direction, until the closed state according to FIG. 7 is reached, in which the outer faces of the core 31 and sliders 32 to 34 rest on the inner faces of the walls 6 to 10. The specific tool 30 can be used particularly advantageously to produce an embodiment of the domestic refrigeration appliance, as described with respect to FIG. 1 to FIG. 5, since at least one electrical part 19 can thus be fitted in a heightwise position behind the separating panel 14 and this can be done before the thermally insulating material is introduced into the space 5, while still allowing the sliders 33 and 34 to be closed easily and the separating panel 14 to be braced from behind. The displacing movement, as described with respect to FIG. 6 and FIG. 7, in which as the core 31 is introduced in the direction P1, the sliders 32 to 34 are displaced relative thereto in the direction of the arrows P2, allows the angled displacement of the sliders 32, 33, 34 to take place without the electrical part 19 being in the way in the interior of the inner container 3. This angled displacement in particular of the slider 34 causes the slider 34 to reach the electrical part in the two spatial directions (height and depth) precisely at the position of the cutout 35, so that when the slider 34 is displaced further into its end position according to FIG. 7, the electrical part 19 can be inserted precisely therein. In particular, the tool 30 is only introduced into the interior of the inner container 3 in its opened position, then the separating panel 14 is fitted and the core 31 is then introduced up to the closed state according to FIG. 7.

The invention claimed is:

1. A domestic refrigeration appliance, comprising:

a housing;

an inner container disposed in said housing, said inner container having walls including side walls, said walls delimiting a receiving chamber for food;

a bearing rib formed on one of said side walls of said inner container for supporting a separating plate, said bearing rib having a front face; and an electrical part disposed on said front face of said bearing rib, extending through a passage in said front face of said bearing rib and projecting into said receiving chamber.

2. The domestic refrigeration appliance according to claim 1, wherein said electrical part is an electric plug.

3. The domestic refrigeration appliance according to claim 1, which further comprises a separate support element disposed in said passage, said electrical part being disposed in said separate support element.

4. The domestic refrigeration appliance according to claim 3, wherein said support element extends on both sides of said passage.

5. The domestic refrigeration appliance according to claim 3, wherein said support element is a sleeve.

6. The domestic refrigeration appliance according to claim 3, wherein said front face has a surface, and said support element has a collar-shaped sealing flange resting on said surface of said front face.

7. The domestic refrigeration appliance according to claim 6, wherein said sealing flange is completely circumferential.

8. The domestic refrigeration appliance according to claim 6, wherein:

said front face has opposite first and second surfaces; and said sealing flange has two sides, a first sealing flange region resting on said first surface of said front face and a second sealing flange region resting on said second surface of said front face.

9. The domestic refrigeration appliance according to claim 3, wherein said support element has a shaft-shaped receiving piece for holding a counter-element to be connected to said electrical part.

10. The domestic refrigeration appliance according to claim 1, wherein:

said front face has a height;

said electrical part has a height being smaller than said height of said front face; and said electrical part disposed in said passage is disposed completely within said height of said front face.

11. The domestic refrigeration appliance according to claim 1, wherein said separating plate rests on said bearing rib, and said electrical part at least partially overlaps said separating plate in a heightwise direction of the domestic refrigeration appliance.

12. The domestic refrigeration appliance according to claim 11, wherein said separating plate has a lower face and a recess in said lower face, said electrical part being inserted in said recess.

13. The domestic refrigeration appliance according to claim 11, which further comprises at least one electrical counter-element disposed in said separating plate, said at least one electrical counter-element being configured to be coupled electrically to said electrical part.

14. The domestic refrigeration appliance according to claim 1, which further comprises a lower face cover covering said electrical part from below.

15. A domestic refrigeration appliance, comprising:

a housing;

an inner container disposed in said housing, said inner container having walls including side walls, said walls delimiting a receiving chamber for food;

a bearing rib formed on one of said side walls of said inner container for supporting a separating plate, said bearing rib having a front face; and an electrical part disposed on said front face of said bearing rib, extending through a passage in said front face of said bearing rib and projecting into said receiving chamber;

said inner container having a loading opening;

a horizontal bar-shaped separating panel dividing said loading opening into two loading opening regions;

said electrical part and said separating panel being disposed at an identical height in a heightwise direction of the domestic refrigeration appliance; and said electrical part being disposed behind said separating panel in a depthwise direction of the domestic refrigeration appliance.

16. A method for producing a domestic refrigeration appliance, the method comprising the following steps:

placing an inner container in a housing, the inner container having walls including side walls, the walls delimiting a receiving chamber for food;

forming a bearing rib on one of the side walls of the inner container for supporting a separating plate, the bearing rib having a front face and a passage in the front face;

inserting a support element into the passage;

inserting an electrical part into the support element causing the electrical part to project into the receiving chamber; and introducing a thermally insulating material into the housing in a region outside the inner container after installing the support element and the electrical part, causing the electrical part to be surrounded by the thermally insulating material outside the inner container.

* * * * *